US006158986A

United States Patent [19]

Casaro et al.

[11] Patent Number: 6,158,986

[45] Date of Patent: Dec. 12, 2000

[54] COMPACT VACUUM PUMP

[75] Inventors: Fausto Casaro, Turin; Raffaella Caretto, Cuceglio, both of Italy

[73] Assignee: Varian, Inc., Palo Alto, Calif.

[21] Appl. No.: 09/310,498

[22] Filed: May 12, 1999

[30] Foreign Application Priority Data

May 27, 1998 [IT] Italy ..... TO98A0453

[51] Int. Cl.[7] ..... F04B 17/00

[52] U.S. Cl. ..... 417/423.4

[58] Field of Search ..... 417/423.12, 423.4, 417/423.13

[56] References Cited

U.S. PATENT DOCUMENTS

| | | | |
|---|---|---|---|
| 5,069,603 | 12/1991 | Schuetz | 417/423.4 |
| 5,165,872 | 11/1992 | Fleischmann et al. | 417/423.4 |
| 5,547,338 | 8/1996 | Conrad et al. | 415/90 |

FOREIGN PATENT DOCUMENTS

| | | |
|---|---|---|
| 2-59294 | 4/1990 | Japan . |
| 5-195982 | 8/1993 | Japan . |
| 9-25890 | 1/1997 | Japan . |
| 10-18991 | 1/1998 | Japan . |

OTHER PUBLICATIONS

U.S. application No. 09/275,732, Hablanian, filed Mar. 24, 1999.

*Primary Examiner*—Timothy S. Thorpe
*Assistant Examiner*—Ehud Gartenberg
*Attorney, Agent, or Firm*—Bella Fishman

[57] ABSTRACT

A vacuum pump (11) comprises a body (1), a rotor member (9) having a plurality of rotor disks (12) coupled to corresponding plurality of stator rings integral to the body (1). The rotor, member has an axial bell-shaped cavity (13). A rotating shaft (15) and an electric motor (7, 8) are disposed within the axial bell-shaped cavity (13). The rotating shaft (15) is supported by rotation supporting means (**5*a*, 5*b*). The electric motor comprises a stator (7) integral to the body (1) of the vacuum pump (11) and a rotor (8) coupled to the internal surface of the axial bell-shaped cavity (13) of the rotor member (9**).

14 Claims, 1 Drawing Sheet

COMPACT VACUUM PUMP

CROSS REFERENCE TO RELATED APPLICATIONS

This application claims the priority of Italian Application No. TO98A000453 filed May 27, 1998, which is incorporated herein by reference.

FIELD OF THE INVENTION

The present invention relates generally to a vacuum pump, and more particularly, to a vacuum pump of the turbo-molecular type, driven by an electric motor.

BACKGROUND OF THE INVENTION

It is well known that a turbo-type vacuum pump comprises an external housing with gas pumping stages housed therein.

The gas pumping stages are generally formed by the arrangement of stator rings integral to the pump body and rotor disks integral to a rotating shaft operated by a motor of the pump.

The rotor disks can be flat disks or be provided with slanting fins.

There are vacuum pumps, generally the turbo-molecular ones, that comprise both flat disks and disks having fins. These pumps allow to obtain pressures of approximately $10^{-8}$ Pa, with very high rotating speeds reaching 100.000 revolutions per minute.

A shaft of the pump rotor and a shaft of the motor normally coincide in one rotating shaft, supported by appropriate rotation supporting means.

Generally the shaft is supported by bearings that can be roller bearings, having balls or rolls, or magnetic bearings. The bearings provide a free rotation and a precise balancing of the shaft.

One type of a conventional vacuum pump is provided with a pair of roller bearings placed on the rotating shaft between the electric motor and the pumping section. Though such configuration has a simple construction and easy maintenance, the motor, the bearings and the pumping section are completely separated there between, which does not allow to manufacture the pumps having compact dimensions, especially in the axial direction.

Another type of a turbo molecular vacuum pump, axially more compact than that described above, is disclosed in the U.S. Pat. No. 5,165,872. The '872 Patent teaches a vacuum pump having a bell-shaped integral pumping rotor having a cylindrical cavity with an electric motor and bearings housed therein in addition to a rotating shaft of a pumping rotor. The motor of this vacuum pump is placed between the bearings and its shaft coincides with the rotating shaft of the pump.

The second type of the turbo-molecular pump is more compact compared to the first one. However, the distance between bearings can never be smaller than the length of the motor.

SUMMARY OF THE INVENTION

Accordingly, it is an object of the present invention to provide a vacuum pump that is axially compact and structurally very simple. The vacuum pump according to the present invention can be advantageously used in all the applications in which it is necessary to reduce to a minimum the dimensions of the pump, without compromising its performance.

The aforesaid and other objects and advantages of the invention will become more evident from the detailed description of a preferred embodiment with reference to the drawing. The detailed description is presented to illustrate the present invention, but is not intended to limit it.

DETAILED DESCRIPTION OF THE INVENTION

Figure 1:
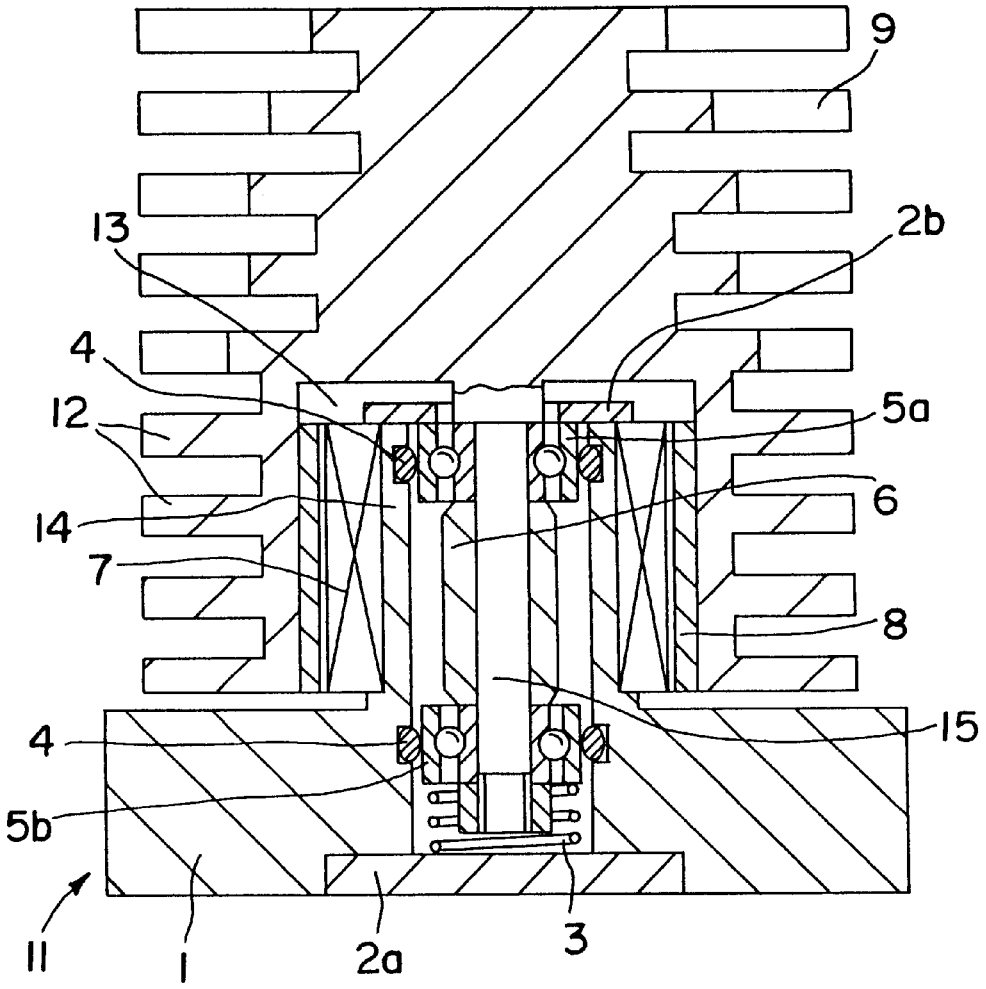
FIG. 1 shows a schematic axial sectional view of a preferred embodiment of a vacuum pump which is constructed in accordance with the principles of the present invention.

With reference to FIG. 1, a vacuum pump 11 comprises a body 1 of the pump, conventionally made of metal, having a base portion and a cylindrical hollow portion 14, serving as basement and support for other elements of the pump. A rotor member 9 has a plurality of rotor disks 12, which are coupled to corresponding plurality of stator rings integral to the body 1 of the pump, not shown in FIG. 1. The cooperation between the stator rings and flat rotor disks 12 allows forming gas-pumping stages of different kinds. Some stages may comprise flat rotor disks, while other stages may comprise rotor disks having slanting fins, according to requested characteristics of the vacuum pump. An axial bell-shaped cavity 13 is formed inside the rotor member 9. A rotating shaft 15 is placed in the center of the axial bell-shaped cavity 13.

A part of the body 1, in particular the cylindrical hollow portion 14, penetrates into the axial bell-shaped cavity 13 of the rotor member 9 and houses internally rotation supporting means 5*a*, 5*b* for the rotating shaft 15. In general, the rotation supporting means can be roller bearings, having balls or rolls, or magnetic bearings coupled to safety ball bearings which intervene in case of sudden malfunctioning of magnetic bearings, for avoiding damages in the pump itself. In particular, in a preferred embodiment shown in FIG. 1, a first 5*a* and a second 5*b* roller bearings are positioned into the cylindrical hollow portion 14.

Each bearing has an outer ring fixed to the internal surface of the hollow cylindrical portion 14, and an inner ring coupled to the rotating shaft 15 of the rotor member 9. A plurality of rolling balls or rolls is placed between the two rings. Two rubber rings 4 are placed between the ball bearings and the internal surface of the cylindrical hollow portion 14.

Advantageously, both bearings 5*a*, 5*b* are placed in the base portion of the pump, corresponding to the cylindrical hollow portion 14. This permits to simplify further the pump structure allowing a better precision and consequently avoiding complex balancing and centering operations of the bearings otherwise necessary for a correct rotation of the pump shaft.

Between the two rolling bearings a spacing bar 6 is disposed. The spacing bar 6 has a substantially cylindrical shape for maintaining a constant distance between the bearings. The bearings 5*a* and 5*b* are kept in position by an axial containment ring 2*b* fixed on the top of the cylindrical hollow portion 14, by a cover 2*a* fixed to the base of the body 1 and by a pre-loading spring 3 placed between, the cover 2*a* and the bearing 5*b*.

An electric motor 7, 8, positioned within the axial bell-shaped cavity 13, comprises a stator 7, integral to the body 1 of the pump, and a rotor 8, coupled to the internal surface of the axial bell-shaped cavity 13 of the rotor member 9. The rotor 8 of the motor is made of an annular permanent magnet, having north and south poles alternating on its circumference, and is keyed into the axial bell-shaped cavity 13 of the rotor member 9. Alternatively the rotor 8 can be made of a plurality of permanent magnets, coupled to the internal surface of the axial bell-shape cavity 13 of the rotor member 9, arranged to form as a whole a magnetic ring having alternating polarities along its circumference.

The magnet or the magnets can be placed into a recess obtained into the axial bell-shaped cavity 13 of the rotor member 9 so that they are coplanar with the internal surface of the bell. In this configuration the space occupied by rotor-stator assembly of the motor can be reduced further. The stator 7, having annular shape, is fixed to the external surface of the cylindrical hollow portion 14 of the body 1, so that it is integral to the body 1 of the pump. The use of a direct current electric motor having a permanent magnet incorporated into the rotor member 9 allows a remarkable simplification of the geometry the pump body in the bearing housing area. The distance between the supporting bearings can be therefore reduced to the minimum necessary to establish a correct balancing of the shaft, without being limited by the physical length of the motor.

The motor rotor is keyed into the cavity 13 of the rotor member 9.

The distance between the rolling bearings 5*a*, 5*b* along the rotating shaft 15 is shorter than the axial length of the motor 7, 8.

The pump design of the present invention allows obtaining a substantial constructive simplicity, an improved compactness especially in the axial direction, and a better bending rigidity that simplifies the balancing operations of the rotating parts.

What is claimed is:

1. A turbomolecular (11) comprising ;

a body (1) having a base portion and a cylindrical hollow portion (14) integral to said base portion and having an internal surface and an external surface;

a rotor member (9) having an axial bell-shaped cavity (13) which partially encloses said cylindrical hollow portion (14) of said body (1);

a rotating shaft (15) disposed within said axial bell-shaped cavity (13), said rotating shaft (15) being coaxial with said cylindrical hollow portion (14);

at least a pair of spaced apart supporting means (5*a*, 5*b*), each having a stationary part integral to the internal surface of said hollow cylindrical portion (14) and a rotational part coupled to said rotating shaft (15); and an electric motor (7, 8) coupled to the external surface of said hollow cylindrical portion (14), corresponding to location of said supporting means (5*a*, 5*b*), said electric motor further comprising a stator (7) integral to the external surface of said cylindrical hollow portion (14) and a rotor (8) coupled to the internal surface of said axial bell-shaped cavity (13), wherein said rotating shaft, at least one of said supporting means, said stator and said rotor are sequentially resting one into the other and extending within said axial bell-shaped cavity in a radial direction.

2. The turbomolecular pump of claim 1, wherein a distance between said supporting means (5*a*, 5*b*) along said rotating shaft (15) is shorter than an axial extension of said electric motor (7, 8).

3. The turbomolecular pump of claim 1, wherein said electric motor is a direct current electric motor.

4. The turbomolecular pump of claim 3, wherein said rotor (8) of said electric motor comprises an annular permanent magnet having north and south poles alternating on its circumference, said rotor is secured within said axial bell-shaped cavity (13) of said rotor member (9).

5. The turbomolecular pump of claim 4, wherein said rotor (8) of the electric motor is placed into a recess formed into said axial bell-shaped cavity (13) of said rotor member (9).

6. The turbomolecular pump of claim 4, wherein said stator (7) of said electric motor has an annular shape and is fixed to the external surface of said cylindrical hollow portion (14) of said body (1) corresponding to said rotor (8) of said electric motor.

7. The turbomolecular pump of claim 3, wherein said rotor (8) of said electric motor is made of a plurality of permanent magnets that is coupled to the internal surface of the axial bell-shaped cavity (13) of said rotor member (9).

8. The turbomolecular pump of the claim 7, wherein said rotor (8) of the electric motor is placed into a recess formed into said axial bell-shaped cavity (13) of said rotor member (9).

9. The turbomoleclar pump of claims 8, wherein said stator (7) of said electric motor has an annular shape and is fixed to the external surface of said cylindrical hollow portion (14) of said body (1) corresponding to the rotor (8) of the electric motor.

10. The turbomolecular pump of claim 1, wherein each said supporting means (5*a*, 5*b*) comprises roller bearings having balls or rolls, each having an outer ring, integral to the internal surface of said hollow cylindrical portion (14) of said body (1), and an inner ring integral to said rotating shaft (15) of said rotor member (9).

11. The turbomolecular pump of claim 10, further comprising rubber rings (4) placed between said outer rings of said rolling bearings and the internal surface of said hollow cylindrical portion (14) of the body (1).

12. The turbomolecular pump of claim 11, further comprising a substantially cylindrical spacing bar (6) between a pair of roller bearings.

13. The turbomolecular pump of claim 12, wherein said supporting means (5*a*, 5*b*) are retained in a predetermined position by an axial containment ring (2*b*) fixed at the top of said cylindrical hollow portion (14), by a cover (2*a*) fixed to the base of the body (1) and by a preloading spring (3).

14. The turbomolecular pump of 1, wherein said supporting means (5*a*, 5*b*) comprise magnetic bearings.

* * * * *